United States Patent [19]

Parent et al.

[11] 3,947,371

[45] Mar. 30, 1976

[54] DEVELOPER MATERIAL WITH POLY(p-XYLYLENE) COATED CARRIER

[75] Inventors: Richard A. Parent, Fairport; H. Ronald Thomas, Rochester, both of N.Y.

[73] Assignee: Xerox Corporation, Stamford, Conn.

[22] Filed: July 19, 1973

[21] Appl. No.: 380,624

Related U.S. Application Data

[62] Division of Ser. No. 308,642, Nov. 21, 1972.

[52] U.S. Cl. ..... 252/62.1 P; 428/405

[51] Int. Cl.[2] ..... G03G 9/00

[58] Field of Search..... 252/62.1 P; 117/100 M

[56] References Cited

UNITED STATES PATENTS

| | | | |
|---|---|---|---|
| 3,054,751 | 9/1962 | Blake et al. | 117/100 M |
| 3,300,332 | 1/1967 | Gorham et al. | 149/7 X |
| 3,429,739 | 2/1969 | Tittmann et al. | 117/106 R X |
| 3,523,839 | 8/1970 | Schehter et al. | 149/7 X |
| 3,556,881 | 1/1971 | Gorham et al. | 149/7 X |
| 3,600,216 | 8/1971 | Stewart | 117/100 M X |
| 3,833,366 | 9/1974 | Madrid et al. | 117/100 M X |

*Primary Examiner*—Samuel Feinberg
*Assistant Examiner*—Peter A. Nelson

[57] ABSTRACT

An electrostatographic developer mixture comprising finely divided toner particles electrostatically clinging to the surface of larger carrier beads, each of the carrier beads comprising a core particle surrounded by a thin outer layer of a poly(p-xylylene) polymer. Imaging processes of developing electrostatic latent images with the developer mixture are also disclosed.

11 Claims, No Drawings

DEVELOPER MATERIAL WITH POLY(P-XYLYLENE) COATED CARRIER

This application is a divisional application of copending application Ser. No. 308,642, filed Nov. 21, 1972.

BACKGROUND OF THE INVENTION

This invention relates in general to electrostatographic imaging systems, and, in particular, to improved developer materials and their use.

The formation and development of images on the surface of photoconductive materials by electrostatic means is well known. The basic electrostatographic process, as taught by C. F. Carlson in U.S. Pat. No. 2,297,691, involves placing a uniform electrostatic charge on a photoconductive insulating layer, exposing the layer to a light and shadow image to dissipate the charge on the areas of the layer exposed to the light and developing the resulting electrostatic latent image by depositing on the image a finely divided electroscopic material referred to in the art as "toner." The toner will normally be attracted to those areas of the layer which retain a charge, thereby forming a toner image corresponding to the electrostatic latent image. This powder image may then be transferred to a support surface such as paper. The transferred image may subsequently be permanently affixed to the support surface as by heat. Instead of latent image formation by uniformly charging the photoconductive layer and then exposing the layer to a light and shadow image, one may form the latent image by directly charging the layer in image configuration. The powder image may be fixed to the photoconductive layer if elimination of the powder image transfer step is desired. Other suitable fixing means such as solvent or overcoating treatment may be substituted for the foregoing heat fixing step.

Many methods are known for applying the electroscopic particles to the electrostatic latent image to be developed. One development method, as disclosed by E. N. Wise in U.S. Pat. No. 2,618,552 is known as "cascade" development. In this method a developer material comprising relatively large carrier particles having finely divided toner particles electrostatically clinging to the surface of the carrier particles is conveyed to and rolled or cascaded across the electrostatic latent image bearing surface. The composition of the toner particles is so chosen as to have a triboelectric polarity opposite that of the carrier particles. As the mixture cascades or rolls across the image bearing surface, the toner particles are electrostatically deposited and secured to the charged portion of the latent image and are not deposited on the uncharged or background portions of the image. Most of the toner particles accidentally deposited in the background are removed by the rolling carrier due apparently to the greater electrostatic attraction between the toner and the carrier than between the toner and the discharged background. The carrier particles and unused toner particles are then recycled. This technique is extremely good for the development of line copy images. The cascade development process is the most widely used commercial electrostatographic development technique. A general purpose office copying machine incorporating this technique is described in U.S. Pat. No. 3,099,943.

Another technique for developing electrostatic latent images is the "magnetic brush" process as disclosed, for example, in U.S. Pat. No. 2,874,063. In this method a developer material containing toner and magnetic carrier particles is carried by a magnet. The magnetic field of the magnet causes alignment of the magnetic carriers in a brushlike configuration. This "magnetic brush" is engaged with an electrostatic latent image bearing surface and the toner particles are drawn from the brush to the electrostatic latent image by electrostatic attraction.

Another technique for developing electrostatic latent images is the "touchdown" process as disclosed, for example, in U.S. Pat. Nos. 2,895,847 and 3,245,823 to Mayo. In this method a developer material is carried to a latent image bearing surface by a support layer such as a web or sheet and is deposited thereon in conformity with said image.

Carrier surfaces and carrier particles are generally made from or coated with materials having appropriate triboelectric properties as well as certain other physical characteristics. Thus, the materials employed as the carrier surfaces and carrier particles or the coatings thereon should have a triboelectric value commensurate with the triboelectric value of the toner to enable electrostatic adhesion of the toner to the carrier surface or carrier particles and subsequent transfer of the toner from the carrier surface or carrier particles to the image on the plate. Furthermore, the triboelectric properties of the carrier surface and all the carrier particles should be relatively uniform to permit uniform pickup and subsequent deposition of toner. The materials employed on the carrier surface and the carrier particles should preferably have an intermediate hardness so as not to scratch the plate or drum surface upon which the electrostatic image is initially placed while being sufficiently hard to withstand the forces to which they are subjected during recycle. The carrier substrate and carrier particles as well as the surface thereof also should not be comprised of materials which are so brittle as to cause either flaking of the surface or particle breakup under the forces exerted on the carrier during recycle. The flaking thereof causes undesirable effects in that the relatively small flaked particles may eventually be transferred to the copy surface thereby interfering with the deposited toner and causing imperfections in the copy image. Furthermore, flaking of the carrier surface will cause the resultant carrier to have nonuniform triboelectric properties when the carrier is composed of a material different from the surface coating thereon. This results in undesirable nonuniform pickup of toner by the carrier and nonuniform deposition of toner on the image. In addition, when the carrier particle size is reduced, the removal of the resultant small particles from the plate becomes increasingly difficult. Thus, the types of materials useful for making carrier or for coating carrier, although having the appropriate triboelectric properties, are limited because other physical properties which they possess may cause the undesirable results discussed above.

While ordinarily capable of producing good quality images, conventional developing materials suffer serious deficiencies in certain areas. The developing materials must flow freely to facilitate accurate metering and even distribution during the development and developer recycling phases of the electrostatographic process. Some developer materials, though possessing desirable properties such as proper triboelectric characteristics, are unsuitable because they tend to cake, bridge and agglomerate during handling and storage. Adherence of carrier particles to reusable electrostatographic imaging surfaces causes the formation of undesirable scratches on the surfaces during the image transfer and surface cleaning steps. The tendency of carrier particles to adhere to imaging surfaces is aggravated when the carrier surfaces are rough and irregular. The coatings of most carrier particles deteriorate rapidly when employed in continuous processes which require the recycling of carrier particles by bucket conveyors partially submerged in the developer supply such as disclosed in U.S. Pat. No. 3,099,943. Deterioration occurs when portions of or the entire coating separates from the carrier core. The separation may be in the form of chips, flakes or entire layers and is primarily caused by fragile, poorly adhering coating material which fails upon impact and abrasive contact with machine parts and other carrier particles. Carriers having coatings which tend to chip and otherwise separate from the carrier core or substrate must be frequently replaced thereby increasing expense and loss of productive time. Thus, generally, coated carrier particles having coatings which tend to chip or separate from the carrier core cannot be reclaimed and reused after many machine cycles. Print deletion and poor print quality occur when carriers having damaged coatings are not replaced. Fines and grit formed from carrier disintegration tend to drift and form undesirable and damaging deposits on critical machine parts. Many carrier coatings having high compressive and tensile strength either do not adhere well to the carrier core or do not possess the desired triboelectric characteristics. In addition, carriers having discontinuous coatings generally promote adhesion failure between the carrier substrate and the carrier coating material giving rise to the aforementioned problems and result in variations in triboelectric characteristics, premature discharge of the photoconductive imaging surface causing degradation of the electrostatic latent image, scratching of the imaging surface, not to mention manufacturing difficulties in reproducing carriers having discontinuous coatings. Further the triboelectric and flow characteristics of many carriers are adversely affected when relative humidity is high. For example, the triboelectric values of some carrier coatings fluctuate with changes in relative humidity and are not desirable for employment in electrostatographic systems, particularly in automatic machines which require carriers having stable and predictable triboelectric values.

Another factor affecting the stability of carrier triboelectric properties is the susceptibility of carrier coatings to "toner impaction." When carrier particles are employed in automatic machines and recycled through many cycles, the many collisions which occur between the carrier particles and other surfaces in the machine cause the toner particles carried on the surface of the carrier particles to be welded or otherwise forced onto the carrier surfaces. The gradual accumulation of impacted toner material on the surface of the carrier causes a change in the triboelectric value of the carrier and directly contributes to the degradation of copy quality by eventual destruction of the toner carrying capacity of the carrier.

It has been ascertained that in order to develop a latent image comprised of negative electrostatic charges, an electroscopic powder and carrier combination should be selected in which the powder is triboelectrically positive to the granular carrier; and to develop a latent image comprised of positive electrostatic charges, an electroscopic powder and carrier should be selected in which the powder is triboelectrically negative to the carrier. It is often desirable in any type of printing to produce a reverse copy of an original. By this is meant to produce a negative copy from a positive original or, on the other hand, a positive copy from a negative original. In electrostatographic printing, image reversal can be accomplished by applying to the image a developer powder which is repelled by the charged areas of the image and adheres to the discharged areas.

The triboelectric relationship between the electroscopic powder and the carrier depends on their relative positions in a triboelectric series in which the materials are arranged in such a way that each material is electrostatically charged with a positive charge when contacted with any material below it in the series and with a negative charge when contacted with any material above it in the series. In the reproduction of high contrast copy such as letters, tracings, etc., it is desirable to select the electroscopic powder and carrier materials so that their mutual electrification is sufficient to cause the toner particles to electrostatically cling to the carrier surface, and the degree of such electrification is normally governed by the distance between their positions in the triboelectric series, that is, the greater distance they are removed from one another, the greater the mutual electrification and the closer they are together in the series, the less the mutual electrification.

It is highly desirable to control the triboelectric properties of carrier surfaces to accommodate the use of desirable toner compositions while retaining the other desirable physical characteristics of the carrier. The alteration of the triboelectric properties of a carrier by applying a surface coating thereon is a particularly desirable technique. With this technique, not only is it possible to control the triboelectric properties of a carrier made from materials having desirable physical characteristics, it is also possible to employ materials previously not suitable as a carrier. Thus, for example, a carrier having desirable physical properties with the exception of hardness, can be coated with a material having desirable hardness as well as other physical properties, rendering the resultant product more useful as a carrier.

Suitable coated and uncoated carrier materials for cascade, magnetic brush, and touchdown development are well known in the art. The carrier comprises any suitable solid material, provided that the carrier acquires charge having an opposite polarity to that of the toner particles when brought in close contact with the toner particles so that the toner particles adhere to and surround the carrier. By proper selection of material in accordance with their position in the triboelectric series, the polarities of their charge when the materials are mixed are such that the electroscopic toner particles adhere to and are coated on the surface of a carrier and also adhere to that portion of the electrostatic image bearing surface having a greater attraction for the toner than the carrier.

For a carrier coating material to be useful in preparing carriers for reversal development, it should have the proper triboelectric properties. A vinyl chloride-vinyl acetate copolymer, as disclosed by L. E. Walkup in U.S. Pat. No. 2,618,551, is used for coating a carrier for use in reversal development of positively charged images. However, this copolymer is not spaced far enough below many toner materials in the triboelectric series to provide high quality reversal images. Therefore, a dye is used to enhance the reversal character of the carrier coating. While the carrier prepared from this polymer-dye blend has utility, it also has disadvantages. Batch to batch uniformity is poor. High speed machines requiring high quality output have great difficulty when trying to use this carrier. The origin of these difficulties probably lies in the incomplete compatibility of the dye with the polymer and possibly may be due to leaching of the dye from the carrier coating composition.

Thus, there is a continuing need for a better developer material for developing electrostatic latent images.

SUMMARY OF THE INVENTION

It is, therefore, an object of this invention to provide developer materials which overcome the above noted deficiencies.

It is another object of this invention to provide developer materials which flow freely.

It is a further object of this invention to provide carrier coating materials which tenaciously adhere to carrier substrates.

It is a still further object of this invention to provide carrier coatings which are more resistant to cracking, chipping, flaking and the like.

It is yet another object of this invention to provide carrier coatings having more stable triboelectric values.

It is a further object of this invention to provide carrier coatings having high tensile and compressive strength.

It is yet another object of this invention to provide carrier coatings having greater resistance to disintegration.

It is still another object of this invention to provide carrier coatings more resistant to toner impaction.

It is still another object of this invention to provide improved developer materials which will not deposit in unwanted areas of an electrostatic latent image.

It is still another object of this invention to provide more uniformly coated electrostatographic carrier materials.

It is still another object of this invention to provide coated carrier materials having controllable triboelectric characteristics.

It is still another object of this invention to provide coated carrier materials having greatly increased life.

It is still another object of this invention to provide coated carrier materials which may be reclaimed.

It is still another object of this invention to provide improved developer materials which may be employed in electrostatographic reversal development.

It is still another object of this invention to provide improved developer materials which may be employed in electrostatographic positive development.

A still further object of this invention is to provide improved developer materials having physical and chemical properties superior to those of known developer materials.

The above objects and others are accomplished, generally speaking, by providing carrier materials comprising a substrate having an outer coating comprising substituted and/or unsubstituted poly (p-xylylene) polymers.

In general, the carrier coating materials of this invention are the products obtained by cleaving the cyclic dimer, [2.2] paracyclophane, and/or derivatives thereof, to provide the reactive vaporous diradicals, and thereafter condensing these vaporous diradicals on the surface of an electrostatographic carrier substrate. Upon condensation, these diradicals instantaneously polymerize to form a film.

The reactive vaporous diradicals hereinabove mentioned can be produced by the thermal homolytic cleavage of at least one cyclic dimer represented generally by the structure:

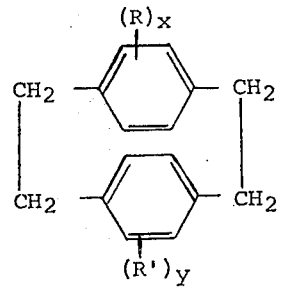

wherein R and R′ are nuclear substituents which may be the same or different, $x$ and $y$ are integers from 1 to 4, inclusive, thus forming two separate reactive vaporous diradicals having the structure:

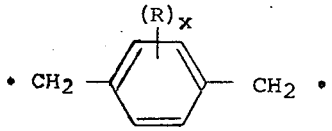

and

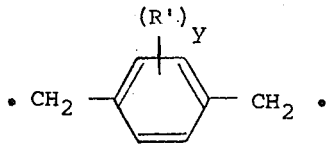

Thus, where $x$ and $y$ are the same, and R and R′ are the same, two moles of the same diradical are formed, and when condensed yield a substituted or unsubstituted homopolymer having the structure:

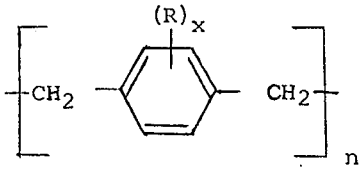

when R and R′ and/or $x$ or $y$ are different, condensation of such diradicals will yield copolymers having the general structure:

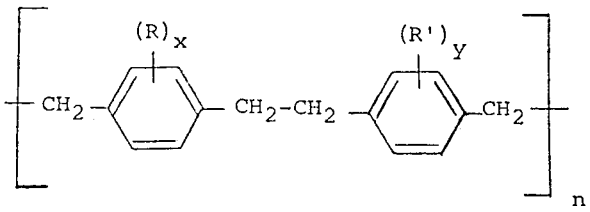

It is also possible to combine several different dimers with various nuclear substituents to form a large number of different and often complicated polymers. This will be obvious to those skilled in the art of polymerization. Furthermore, analogous systems having fused aromatic rings in the dimer structure and polymers resulting therefrom should not be considered beyond the scope of this invention and are obvious to those skilled in the art.

Inasmuch as the coupling of these reactive diradicals involves the methylene linkages, many unsubstituted or nuclear substituted poly(p-xylylene) polymers can be prepared. Thus, the substituent group can be any organic or inorganic group which can normally be substituted on aromatic nuclei. Illustration of such substituent groups are alkyl, aryl, alkenyl, amino, cyano, carboxyl, alkoxy, hydroxy alkyl, carbaloxy, hydroxyl, nitro, halogen, and other similar groups which may normally be substituted on aromatic nuclei. Otherwise, the position on the aromatic ring is filled by a hydrogen atom.

Particularly preferred of the substituted groups are those simple hydrocarbon groups such as the lower alkyls like methyl, ethyl, propyl, butyl, hexyl; lower aryl hydrocarbons such as phenyl, aklylated phenyl, naphthyl; and the halogen groups, particularly chlorine, bromine, iodine, and fluorine because electrostatographic carrier coating materials having maximum adhesion to carrier substrates and stable triboelectric properties are obtained.

The substituted [2.2] paracyclophanes from which these reactive diradicals are prepared, can be prepared from the cyclic dimer, [2.2] paracyclophane, by appropriate treatment such as halogenation acetylation, nitration, alkylation, and like methods of introduction of substituent groups onto aromatic nuclei. Hereinafter the term a "[2.2] paracyclophane" refers to any substituted or unsubstituted [2.2] paracyclophane as hereinabove discussed.

In the polymerization process to provide the electrostatographic carrier coating materials of this invention, the thermally generated vaporous diradicals condense and polymerize instantaneously on the carrier substrate. Thus, substituted and/or unsubstituted p-xylylene polymer carrier coatings can be made by cooling the vaporous diradicals down to any temperature at or below the condensation temperature of the diradical. It has been observed that for each diradical species, there is an optimum ceiling condensation temperature above which the diradical will not condense and polymerize onto the carrier substrate. Substituted or unsubstituted poly (p-xylylene) electrostatographic carrier coating polymeric materials are made by maintaining the carrier substrate surface at a temperature below the ceiling condensation temperature of the particular diradical species involved.

Where different diradicals existing in the pyrolyzed mixture have different ceiling condensation temperatures, as for example, p-xylylene, or cyano-p-xylylene and chloro-p-xylylene or any other mixture with other substituted diradicals, homopolymerization will result when the condensation temperature is selected to be at or below that temperature where only one of the diradicals condense and polymerize. Therefore, it is possible to make homopolymer carrier coating materials from a mixture containing one or more of the substituted diradicals when any other diradicals present have higher condensation temperatures, and wherein only one diradical species is condensed and polymerized on the carrier surface. Of course, other diradical species not condensed on the carrier substrate surface can be drawn through well-known coating apparatus to be condensed and polymerized in a subsequent coating chamber or cold trap. Inasmuch as p-xylylene diradicals, for example, are condensed at temperatures at about 25° to 30°C., which is much lower than cyano-p-xylylene diradicals, i.e., about 120° to 130°C., it is possible to have such diradicals present in the vaporous pyrolyzed mixture. In such a case, homopolymerizing conditions are secured by maintaining the electrostatographic carrier substrate surface at a temperature below the ceiling condensation temperature of the substituted p-xylylene but above that of the p-xylylene, thus permitting the p-xylylene vapors to pass through the apparatus without condensing and polymerizing but collecting the poly-p-xylylene in a subsequent coating chamber or cold trap.

It is also possible to obtain substituted copolymer carrier coating materials through the pyrolysis process hereinabove described. Copolymers of p-xylylene and substituted p-xylylene, as well as copolymers of substituted p-xylylenes can all be obtained through said pyrolysis process. Copolymerization occurs simultaneously with condensation upon cooling of the vaporous mixture of reactive diradicals to a temperature below about 200°C. under polymerization conditions. Electrostatographic carrier coating copolymer materials can be made by maintaining the substrate surface at a temperature below the lowest ceiling condensation temperature of the diradical desired in the copolymer, such as at room temperature or below. This is condensed "copolymerizing conditions," since at least two of the diradicals will condense and copolymerize in a copolymer at such temperature.

In the pyrolytic process, the reactive diradicals are prepared by pyrolyzing a substituted and/or unsubstituted [2.2] paracyclophane at a temperature less than about 700°C., and preferably at a temperature between about 550°C. to about 650°C. Pyrolysis of the starting [2.2] paracyclophane begins at about 450°C. regardless of the pressure employed. Operation in the range of 450°–550°C. serves only to increase the time of reaction, lessen the yield of polymer secured, and may result in entraining unpyrolyzed dimer in the polymer film. At temperatures above about 700°C., cleavage of the substituent group may occur, resulting in a tri/or polyfunctional species causing cross-linking or highly branched polymers.

The pyrolysis temperature is essentially independent of the operating pressure. It is, however, preferred that reduce or sub-atmospheric pressures be employed. For most operations, pressures within the range of 0.0001 to 10 mm Hg. absolute are most practical. However, if desired, greater pressures can be employed. Likewise, if desirable, inert vaporous diluents such as nitrogen, argon, carbon dioxide, steam, and the like can be employed to vary the optimum temperature of operation or to change the total effective pressure in the system.

Where greater adhesion of poly(p-xylylene) polymers to electrostatographic carrier substrate surfaces is desired, improved adhesion may be obtained by the use of a substituted silicon compound. That is, poly(p-xylylene) polymers can be adhered to electrostatographic carrier substrate surfaces by providing on the surface of the carrier substrate a silane compound containing an ethylenically unsaturated group bonded to the silicon of the silane by a carbon-to-silicon bond, and contacting the carrier substrate with a vaporous p-xylylene diradical which upon deposition on the surface of the carrier substrate forms a poly(p-xylylene) coating which adheres to the carrier substrate surface.

It is well known that siloxanes can be condensed and hydrolyzed products of substituted silanes. Such compounds can be prepared by any convenient method known in the art. Preferably the siloxanes are formed when reacting the silicon compound containing solution with hydroxyl or oxide surface groups of the substrate. THe siloxanes can be produced from substituted silanes represented generally by the structure

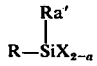

wherein R is an ethylenically unsaturated group bonded to the silicone by a carbon-to-silicon bond such as those compounds having the structure.

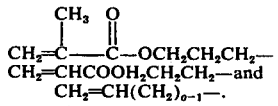

R′ is a monovalent hydrocarbon group bonded to silicon by a carbon to silicon bond; X is a hydrolyzable and/or condensable radical such as halogen, alkoxy, aryloxy, acyloxy, and the like; and *a* is 0, 1, or 2. Specific illustrations of such substituted silanes containing an ethylenically unsaturated group bonded to the silicon of the silane by a carbon to silicon bond, and at least one hydrolyzable group attached directly to the silicon of the silane are vinyltrichloro silane, vinylmethyldichloro silane, and gammamethacryloxypropyltrimethoxy silane. Organo silicon compounds useful in the present invention are known in the art and can be prepared by any conventional method known in the art.

The electrostatographic carrier substrates of this invention may be provided on their surfaces with a siloxane containing an ethylenically unsaturated group bonded to the silicon of the siloxane by a carbon-to-silicon bond by treating the substrates with a solution produced by dissolving in a solvent a substituted silane containing an ethylenically unsaturated group identical to that of the siloxane and at least one hydrolyzable group attached directly to the silicon of the silane. The solvent employed can vary with the particular silane used. The solvent can vary from halocarbons such as trichloroethylene to ethanol-water or methanol-water mixtures and any suitable solvent system. The amount of silane in solution can be from about 0.05 to about 20% depending upon the solvent employed. It must be understood that the solvent used and the amount of silane in solution can vary widely and such variations should not be construed as being outside the scope of this invention. Furthermore, solvents other than those specifically named as being preferred, can also be effectively employed without detracting from this invention. It must be understood that the solution can also be formed of a siloxane containing an ethylenically unsaturated group bonded to the silicon of the siloxane by a carbon-to-silicon bond and at least one hydrolyzable and/or condensable group attached directly to the silicon of the silane. Specific illustrations of the preferred types of solutions which can be employed are a 10% solution of vinyltrichloro silane in trichloroethylene, 0.1% gamma-methacryloxypropyl trimethoxy silane in 99.4% methanol—0.5% water. These solutions have been preferred, and references to such should not be construed to limit the combinations possible in making a solution of the silicon compound. The substrates can be treated with the aforementioned solutions by such techniques as dipping the substrates directly onto the solution, or other conventional techniques. It is also preferred that the treated substrates be dried at ambient temperatures to effect evaporation of the carrier solvent. In certain instances such as when treating the substrates with a 1% solution of gamma-methacryloxypropyltrimethoxy silane in 95/5 ethanolwater, it is preferably to bake the substrate at temperatures from about 50°–70°C. after air drying in order to remove the residual non-reacted silane and the rest of the carrier solvent. However, such baking is not always necessary but depends upon the silane and solution used. Other methods of applying the silane from solution or otherwise will be obvious to those skilled in the art. In addition, other adhesion promotion techniques are known and may be employed if desired for the purposes of this invention.

Any suitable electrostatographic carrier coating thickness may be employed. However, a carrier coating having a thickness at least sufficient to form a thin continuous film on a substrate is preferred because the carrier coating will then possess sufficient thickness to resist abrasion and prevent pinholes which adversely affect the triboelectric properties of the coated carrier particles. Generally, for cascade and magnetic brush development, the poly(p-xylylene) carrier coating may comprise from about 50 angstroms to about 5 microns in thickness. Preferably, the poly(p-xylylene) electrostatographic carrier coating should comprise from about 500 angstroms to about 1 micron in thickness because maximum durability, toner impaction resistance, and copy quality are achieved.

Any suitable well known coated or uncoated carrier material may be employed as the substrate for the coated electrostatographic carriers of this invention. Typical carrier core materials include sodium chloride, ammonium chloride, aluminum potassium chloride, Rochelle salt, sodium nitrate, potassium chlorate, granular ziron, granular silicon, methyl methacrylate, glass, silicon dioxide, flintshot, iron, steel, ferrite, nickel, carborundum and mixtures thereof. Many of the foregoing and other typical carrier materials are described by L. E. Walkup in U.S. Pat. No. 2,618,551; L. E. Walkup el al. in U.S. Pat. No. 2,638,416; E. N. Wise in U.S. Pat. No. 2,618,552; and C. R. Mayo in U.S. Pat. Nos. 2,805,847 and 3,245,823. An ultimate coated carrier particle having an average diameter between about 1 micron to about 1,000 microns may be employed. However, a coated carrier particle having an average diameter between about 50 microns and about 600 microns is preferred in cascade systems because the carrier particle then possesses sufficient density and inertia to avoid adherence to the electrostatic images during the cascade development process. Adherence of carrier particles to an electrostatographic drum is undesirable because of the formation of deep scratches on the drum surface during the image transfer and drum cleaning steps, particularly where cleaning is accomplished by a web cleaner such as the web disclosed by W. P. Graff, Jr., et al. in U.S. Pat. No. 3,186,838.

The surprisingly better results obtained with the poly(p-xylylene) electrostatographic carrier coating materials of this invention may be due to many factors. For example, the marked durability of the coating material may be due to the fact that these poly(p-xylylene) polymers adhere extremely well to the substrates tested. Outstanding abrasion resistance is obtained when the poly(p-xylylene) coating materials of this invention are applied to steel or similar metallic particles. Coatings prepared from the polymers of this invention possess smooth outer surfaces which are highly resistant to cracking, chipping, and flaking. In cascade development systems, the smooth tough surface enhances the rolling action of carrier particles across the electrostatographic surfaces and reduces the tendency of carrier particles to adhere to the electrostatographic imaging surfaces. When these poly(p-xylylene) polymers are employed in coatings for electrostatographic carriers, carrier life is unexpectedly extended, particularly with respect to stability of triboelectric properties. Additionally, the hydrophobic properties of the carrier coating materials of this invention appear to contribute to the stability of the triboelectric properties of the coated carrier over a wide relative humidity range. Because of their triboelectric properties, these poly(p-xylylene) polymeric coating materials may be employed in reversal development of positively charged images without incorporating reversal dyes in the carrier coating.

The carrier coatings employed in the present invention are nontacky and have sufficient hardness at normal operating temperatures to minimize impaction; form strong adhesive coatings which resist flaking under normal operating conditions; have triboelectric values such that they can be used with a wide variety of presently available toners in present positive and negative electrostatographic processes and are hydrophobic so that they retain a predictable triboelectric value. Thus, the coated carrier particles of this invention have desirable properties which permit their wide use in presently available electrostatographic processes.

Any suitable poly(p-xylylene) polymer may be employed as the carrier coating of this invention. Typical poly(p-xylylene) polymers include poly(chloro-p-xylylene), poly(dichloro-p-xylylene), poly(cyano-p-xylylene), poly(iodo-p-xylylene), poly(fluoro-p-xylylene), poly(bromo-p-xylylene), poly(methoxy-methyl-p-xylylene), poly(hydroxy-methyl-p-xylylene), poly(ethyl-p-xylylene), poly(methyl-p-xylylene), poly(aminomethyl-p-xylylene) hydrate, poly(carboxy-p-xylylene), poly(carbomethoxy-p-xylylene), and mixtures thereof.

Any suitable well-known toner material may be employed with the poly(p-xylylene) coated carriers of this invention. Typical toner materials include gum copal, gum sandarac, rosin, cumaroneindene resin, asphaltum, gilsonite, phenolformaldehyde resins, rosin modified phenolformaldehyde resins, methacrylic resins, polystyrene resins, polypropylene resins, epoxy resins, polyethylene resins, polyester resins and mixtures thereof. The particular toner material to be employed obviously depends upon the separation of the toner particles from the poly(p-xylylene) coated carrier in the triboelectric series and should be sufficient to cause the toner particles to electrostatically cling to the carrier surface. Among the patents describing electroscopic toner compositions are U.S. Pat. No. 2,659,670 to Copley; U.S. Pat. No. 2,753,308 to Landrigan; U.S. Pat. No. 3,079,342 to Insalaco; U.S. Pat. Re. No. 25,136 to Carlson and U.S. Pat. No. 2,788,288 to Rheinfrank et al. These toners generally have an average particle diameter between about 1 and 30 microns.

Any suitable colorant such as a pigment or dye may be employed to color the toner particles. Toner colorants are well known and include, for example, carbon black, nigrosine dye, aniline blue, Calco Oil Blue, chrome yellow, ultramarine blue, Quinoline Yellow, methylene blue chloride, Monastral Blue, Malachite Greene Ozalate, lampblack, Rose Bengal, Monastral Red, Sudan Black BM, and mixtures thereof. The pigment or dye should be present in the toner in a sufficient quantity to render it highly colored so that it will form a clearly visible image on a recording member. Preferably, the pigment is employed in an amount from about 3 percent to about 20 percent, by weight, based on the total weight of the colored toner because high quality images are obtained. If the toner colorant employed is a dye, substantially smaller quantities of colorant may be used.

Any suitable conventional toner concentration may be employed with the poly(p-xylylene) coated carriers of this invention. Typical toner concentrations for cascade and magnetic brush development systems include about 1 part toner with about 10 to about 400 parts by weight of carrier.

Any suitable organic or inorganic photoconductive material may be employed as the recording surface with the poly(p-xylylene) coated carriers of this invention. Typical inorganic photoconductor materials include: sulfur, selenium, zinc sulfide, zinc oxide, zinc cadmium sulfide, zinc magnesium oxide, cadmium selenide, zinc silicate, calcium strontium sulfide, cadmium sulfide, mercuric iodide, mercuric oxide, mercuric sulfide, indium trisulfide, gallium selenide, arsenic disulfide, arsenic trisulfide, arsenic triselenide, antimony trisulfide, cadmium sulfo-selenide and mixtures thereof. Typical organic photoconductors include: guinacridone pigments, phthalocyanine pigments, triphenylamine, 2,4-bis(4,4'-diethylamino-phenol)-1,3,4-oxadiazol, N-isopropylcarbazol, triphenyl-pyrrol, 4,5-diphenylimidazolidinone, 4,5-diphenylimidazolidinethione, 4,5-bis-(4'-amino-phenyl)-imidazolidinone, 1,5-dicyanonaphthalene, 1,4-dicyanonaphthalene, aminophthalodinitrile, nitrophthalodinitrile, 1,2,5,6-tetraazacyclooctatetraene-(2,4,6,8), 2-mercaptobenzothiazole-2-phenyl-4-diphenylidene-oxazolone, 6-hydroxy-2,3-di(p-methoxyphenyl)-benzofurane, 4-dimethylamino-benzylidene-benzhydrazide, 3-benzylidene-amino-carbazole, polyvinyl carbazole, (2-nitrobenzylidene)-p-bromoaniline, 2,4-diphenylquinazoline, 1,2,4-triazine, 5-diphenyl-3-methylpyrazoline, 2-(4'dimethylamino phenyl)-benzoxazole, 3-amine-carbazole, and mixtures thereof. Representative patents in which photoconductive materials are disclosed include U.S. Pat. No. 2,803,541 to Ullrich, U.S. Pat. No. 2,970,906 to Bixby, U.S. Pat. No. 3,121,006 to Middleton, U.S. Pat. No. 3,121,007 to Middleton, and U.S. Pat. No. 3,151,982 to Corrsin.

Poly(p-xylylene) carrier coatings provide numerous advantages to an electrostatographic carrier because they confer a uniform coating and yield better batch to batch triboelectric reproducibility than current carriers. In addition, the carrier coatings of this invention provide exceptionally good life performance, durability, copy quality, quality maintenance, less coated carrier bead sticking and agglomeration, and also provide improved abrasion resistance thereby minimizing carrier coating chipping and flaking. Further, recovery of coated carrier is possible since the poly(p-xylylene) polymeric materials are quite insoluble in solvents that readily dissolve current conventional toner materials thereby enabling the removal of impacted toner from the coated carrier and also enabling the re-establishment of the original carrier-toner triboelectric relationship. The toner material may thus be readily removed from the coated carrier which is then reusable without further processing.

The following examples, other than the control examples, further define, describe, and compare preferred methods of utilizing the poly(p-xylylene) coated carriers of the present invention in electrostatographic applications. Parts and percentages are by weight unless otherwise indicated.

EXAMPLE I

Electrostatographic poly(p-xylylene) coated carrier particles are prepared by placing a supply of the cyclic dimer, [2.2] paracyclophane, in a sublimer which is heated to a temperature of about 140°C. Sublimation is carried out under a vacuum at about 10 microns of Hg. The sublimed vapors enter a pyrolysis furnace maintained at a temperature of about 680°C. and under a vacuum of about 10 microns of Hg. In this pyrolysis zone the dimer is converted to reactive diradicals which pass into a deposition zone maintained at a temperature of about 25°C. and containing about 200 grams of 450 micron steel carrier cores. The deposition chamber is rotated at a speed of between about 10 r.p.m. and about 50 r.p.m. Upon contacts of the reactive diradicals with the steel carrier cores, a thin, hard, continuous coating of poly(p-xylylene) forms on the steel carrier cores. Vapors which do not condense in the deposition zone are removed by a cold trap which protects the vacuum pump from contamination. The coated steel carrier cores are removed from the deposition chamber. Examination showed the poly(p-xylylene) was adhered to the carrier cores and no further treatment was necessary.

EXAMPLE II

Electrostatographic poly(chloro-p-xylylene) carrier particles are prepared by placing a supply of the cyclic dimer, [2.2] paracyclophane having a chlorine atom substituted on each aromatic ring, in a sublimer which is heated to a temperature of about 140°C. Sublimation is carried out under vacuum at about 10 microns of Hg. The sublimed vapors enter a pyrolysis furnace maintained at a temperature of about 680°C. and under a vacuum of about 10 microns of Hg. In this pyrolysis zone the dimer is converted to reactive diradicals which pass into a deposition zone maintained at a temperature of about 25°C. and containing about 200 grams of 450 micron steel carrier cores. The deposition chamber is rotated at a speed of between about 10 r.p.m. and about 50 r.p.m. Upon contact of the reactive diradicals with the steel carrier cores, a thin, hard, continuous coating of poly(chloro-p-xylylene) forms on the steel carrier cores. Vapors which do not condense in the deposition zone are removed by a cold trap which protects the vacuum pump from contamination. The coated steel carrier cores are removed from the deposition chamber. Examination showed the poly(chloro-p-xylylene) was adhered to the carrier cores and no further treatment was necessary.

EXAMPLE III

Electrostatographic poly(dichloro-p-xylylene) carrier particles are prepared by placing a supply of the cyclic dimer, [2.2] paracyclophane, having two chlorine atoms substituted on each aromatic ring, in a sublimer which is heated to a temperature of about 140°C. Sublimation is carried out under vacuum at about 10 microns of Hg. The sublimed vapors enter a pyrolysis furnace maintained at a temperature of about 680°C. and under a vacuum of about 10 microns of Hg. In this pyrolysis zone the dimer is converted to reactive diradicals which pass into a deposition zone maintained at a temperature of about 25°C. and containing about 200 grams of 450 micron steel carrier cores. The deposition chamber is rotated at a speed of between 10 r.p.m. and about 50 r.p.m. Upon contact of the reactive diradicals with the steel carrier cores, a thin, hard, continuous coating of poly(dichloro-p-xylylene) forms on the steel carrier cores. Vapors which do not condense in the deposition zone are removed by a cold trap which protects the vacuum pump from contamination. The coated steel carrier cores are removed from the deposition chamber. Examination showed the poly(dichloro-p-xylylene) was adhered to the carrier cores and no further treatment was necessary.

EXAMPLE IV

Electrostatographic poly(p-xylylene) carrier particles are prepared by placing a supply of the cyclic dimer, [2.2] paracyclophane, in a sublimer which is heated to a temperature of about 140°C. Sublimation is carried out under vacuum at about 10 microns of Hg. The sublimed vapors enter a pyrolysis furnace maintained at a temperature of about 680°C. and under a vacuum of about 10 microns of Hg. In this pyrolysis zone the dimer is converted to reactive diradicals which pass into a deposition zone maintained at a temperature of about 25°C. and containing about 200 grams of 250 micron steel carrier cores which have been precoated with about a 0.7% by volume solution of gamma-methacryloxypropyltrimethoxy silane in 99.4% methanol—0.5% water. The carrier cores were dipped in the silane solution for 10 minutes, air dried for 30 minutes, and then baked at 70°C. for 30 minutes. The deposition chamber is rotated at a speed of between about 10 r.p.m. and about 50 r.p.m. Upon contact of the reactive diradicals with the precoated steel carrier cores, a thin, hard, continuous coating of poly(p-xylylene) forms on the steel carrier cores. Vapors which do not condense in the deposition zone are removed by a cold trap which protects the vacuum pump from contamination. The coated steel carrier cores are removed from the deposition chamber. Examination showed the poly(p-xylylene) was adhered to the carrier cores and no further treatment was necessary.

EXAMPLE V

Electrostatographic poly(chloro-p-xylylene) carrier particles are prepared by placing a supply of the cyclic dimer, [2.2] paracyclophane, having a chlorine atom substituted on each aromatic ring, in a sublimer which is heated to a temperature of about 140°C. Sublimation is carried out under vacuum at about 10 microns of Hg. The sublimed vapors enter a pyrolysis furnace maintained at a temperature of about 680°C. and under a vacuum of about 10 microns of Hg. In this pyrolysis zone the dimer is converted to reactive diradicals which pass into a deposition zone maintained at a temperature of about 25°C. and containing about 200 grams of 250 micron steel carrier cores which have been precoated with about a 0.7% by volume solution of gammamethacryloxypropyltrimethoxy silane as in Example IV. The deposition chamber is rotated at a speed of between about 10 r.p.m. and about 50 p.r.m. Upon contact of the reactive diradicals with the steel carrier cores, a thin, hard, continuous coating of poly(-chloro-p-xylylene) forms on the steel carrier cores. Vapors which do not condense in the deposition zone are removed by a cold trap which protects the vacuum pump from contamination. The coated steel carrier cores are removed from the deposition chamber. Examination showed the poly(chloro-p-xylylene) was adhered to the carrier cores and no further treatment was necessary.

EXAMPLE VI

Electrostatographic poly(dichloro-p-xylylene) carrier particles are prepared by placing a supply of the cyclic dimer, [2.2] paracyclophane, having two chlorine atoms substituted on each aromatic ring, in a sublimer which is heated to a temperature of about 140°C. Sublimation is carried out under vacuum at about 10 microns of Hg. The sublimed vapors enter a pyrolysis furnace maintained at a temperature of about 680°C. and under a vacuum of about 10 microns of Hg. In this pyrolysis zone the dimer is converted to reactive diradicals which pass into a deposition zone maintained at a temperature of about 25°C. and containing about 200 grams of 250 micron steel carrier cores which have been precoated with about a 0.7% by volume solution of gamma-methacryloxypropyltrimethoxy silane as in Example IV. The deposition chamber is rotated at a speed of between about 10 r.p.m. and about 50 r.p.m. Upon contact of the reactive diradicals with the steel carrier cores, a thin, hard, continuous coating of poly(-dichloro-p-xylylene) forms on the steel carrier cores. Vapors which do not condense in the deposition zone are removed by a cold trap which protects the vacuum pump from contamination. The coated steel carrier cores are removed from the deposition chamber. Examination showed the poly(dichloro-p-xylylene) was adhered to the carrier cores and no further treatment was necessary.

EXAMPLE VII

A control sample containing about one part colored toner particles having an average particle size of about 10 to about 20 microns and about 99 parts coated carrier particles comprising 450 micron steel carrier cores coated with a vinyl chloride-vinyl acetate copolymer containing about 25.0 percent by weight based on the weight of the copolymer of a reversal dye is cascaded across an electrostatic image-bearing surface. The resultant developed image is transferred by electrostatic means to a sheet of paper whereon it is fused by heat. The residual powder is removed from the electrostatic imaging surface by a cleaning web of the type disclosed by W. P. Graff, Jr., et al. in U.S. Pat. No. 3,186,838. After the copying process is repeated 50,000 times, the developer mix is examined for the presence of carrier coating chips and flakes. Numerous carrier chips and flakes are found in the developer mix. Print quality is found to degrade throughout the test and to be poor at the conclusion of the test.

EXAMPLE VIII

A developer sample is prepared by mixing about one part colored toner particles having an average particle size of about 10 to about 20 microns with about 99 parts of the coated carrier particles of Example I. The developing procedure of Example VII is repeated with the foregoing coated carrier substituted for the carrier employed in Example VII. However, the copying process is repeated 326,000 times rather than 50,000 times. An examination of the developer mix after the test termination reveals substantially no carrier coating chips nor flakes. Print quality is found to be good at the conclusion of the test.

EXAMPLE IX

A developer sample is prepared by mixing about one part colored toner particles having an average particle size of about 10 to about 20 microns with about 99 parts of the coated carrier particles of Example II. The developing procedure of Example VII is repeated with the foregoing coated carrier substituted for the carrier employed in Example VII. An examination of the developer mix after the test termination reveals substantially no carrier coating chips nor flakes.

EXAMPLE X

A developer sample is prepared by mixing about one part colored toner particles having an average particle size of about 10 to about 20 microns with about 99 parts of the coated carrier particles of Example III. The developing procedure of Example VII is repeated with the foregoing coated carrier substituted for the carrier employed in Example VII. An examination of the developer mix after the test termination reveals substantially no carrier coating chips nor flakes.

EXAMPLE XI

A developer sample is prepared by mixing about one part colored toner particles having an average particle size of about 10 to about 20 microns with about 99 parts of the coated carrier particles of Example IV. The developing procedure of Example VII is repeated with the foregoing coated carrier substituted for the carrier employed in Example VII. However, the copying process is repeated 400,000 times rather than 50,000 times. An examination of the developer mix after the test termination reveals substantially no carrier coating chips nor flakes.

EXAMPLE XII

A developer sample is prepared by mixing about one part colored toner particles having an average particle size of about 10 to about 20 microns with about 99 parts of the coated carrier particles of Example V. The developing procedure of Example VII is repeated with the foregoing coated carrier substituted for the carrier employed in Example VII. An examination of the developer mix after the test termination reveals substantially no carrier coating chips nor flakes.

EXAMPLE XIII

A developer sample is prepared by mixing about one part colored toner particles having an average particle size of about 10 to about 20 microns with about 99 parts of the coated carrier particles of Example VI. The developing procedure of Example VII is repeated with the foregoing coated carrier substituted for the carrier employed in Example VII. An examination of the developer mix after the test termination reveals substantially no carrier coating chips nor flakes.

EXAMPLE XIV

The developer materials of Example VII and Example VIII are separately cascaded across an electrostatic image-bearing surface. The developed images are then electrostatically transferred to receiving sheets. The development and transfer steps are repeated at different relative humidities in 10 percent increments from 20 percent to 80 percent. The resolutions in lines per millimeter of each of the transferred images is plotted against the corresponding percent relative humidity. The change in resolution between 20 and 80 percent relative humidity for the developer material of Example VII is more than four times greater than the change in resolution for the developer material of Example VIII.

EXAMPLE XV

A control sample containing about one part colored toner particles having an average particle size of about 10 to about 20 microns and about 99 parts coated carrier particles comprising 450 micron steel carrier cores coated with a vinyl chloride-vinyl acetate copolymer containing about 25.0 percent by weight based on the weight of the copolymer of a reversal dye is cascaded across an electrostatic image-bearing surface. Substantial toner impaction along with coating chips and flakes are observed within about five hours after the test is initiated. Copy quality was found to deteriorate to an unacceptable level.

EXAMPLE XVI

The developer material of Example VIII is evaluated according to the impaction test procedure of Example XV. Toner impaction is observed at about 25 hours after the test was initiated but without deterioration of copy quality. No carrier coating cips or flakes are found.

In the following Examples XVII through XIX, the relative triboelectric values generated by contact of carrier beads with toner particles is measured by means of a Faraday Cage. The device comprises a brass cylinder having a diameter of about one inch and a length of about 1 inch. A 100-mesh screen is positioned at each end of the cylinder. The cylinder is weighed, charged with about a 0.5 gram mixture of carrier and toner particles and connected to ground through a capacitor and an electrometer connected in parallel. Dry compressed air is then blown through the brass cylinder to drive all the toner from the carrier. The charge on the capacitor is then read on the electrometer. Next, the chamber is reweighed to determine the weight loss. The resulting data is used to calculate the toner concentration and the charge in micro-coulombs per gram of toner. Since the triboelectric measurements are relative, the measurements should, for comparative purposes, be conducted under substantially identical conditions. Thus, a toner comprising a styrene-n-butyl methacrylate copolymer and carbon black as disclosed by M. A. Insalaco in U.S. Pat. No. 3,079,342 is used as a contact triboelectrification standard in Examples XVII through XIX. Obviously, other suitable toners such as those listed above may be substituted for the toner used in the examples.

EXAMPLE XVII

A control sample is produced by mixing about one part colored styrene-n-butyl methacrylate copolymer toner particles having an average particle size of about 5 to about 15 microns with about 200 parts of the coated carrier particles disclosed in Example VII. The relative triboelectric value of the carrier measured by means of a Faraday Cage is about −20 micro-coulombs per gram of toner. In machine life tests employing cascade development of a positively charged reusable imaging surface and developing discharged image areas with unexposed areas still positively charged, the carrier fails between about 40,000 and about 70,000 prints. Substantial toner impaction and carrier abrasion are observed. Print quality is poor at the conclusion of the test, and the triboelectric value has degraded to about −7 micro-coulombs per gram of toner.

EXAMPLE XVIII

A developer sample is produced by mixing about one part colored styrene-n-butyl methacrylate copolymer toner particles of the type described in Example XVII with about 200 parts of the coated carrier particles of Example I. The relative triboelectric value of the carrier measured by means of a Faraday Cage is about −20 micro-coulombs per gram of toner. In machine life tests, as in Example XVII, the carrier performs well up to about 400,000 prints. Substantially less toner impaction per 1,000 copies and less carrier abrasion than the carrier of Example XVII is observed. Print quality is good throughout the test, and the triboelectric value is found not to have degraded below a useful level.

EXAMPLE XIX

A developer sample is produced by mixing about one part colored styrene-n-butyl methacrylate copolymer toner particles of the type described in Example XVII with about 200 parts of the coated carrier particles of Example IV. The relative triboelectric value of the carrier measured by means of a Faraday Cage is about −20 micro-coulombs per gram of toner. In machine life tests employing magnetic brush development of a negatively charged reusable imaging surface the carrier performs well and print quality is good throughout the test. Substantially no toner impaction or carrier abrasion is observed.

EXAMPLE XX

The developer material of Example VIII was run in a cascade reversal development apparatus to 326,000 cycles at which point the control latitude of toner concentration to triboelectricity became narrow and the test was terminated. The coated carrier was washed with benzene, air dried, and re-installed in the above development apparatus. Print quality and toner concentration to triboelectricity control latitude is found to have regained original latitude. Carrier life of the original poly(p-xylylene) coated carrier is found to exceed 500,000 cycles without degradation of the carrier coating.

Although specific materials and conditions were set forth in the above examples for making and using the developer materials of this invention, these are merely intended as illustrations of the present invention. Various other toners, carrier cores, substituents and processes such as those listed above may be substituted for those in the examples with similar results.

Other modifications of the present inventions will occur to those skilled in the art upon a reading of the present disclosure. These are intended to be included within the scope of this invention.

What is claimed is:

1. An electrostatographic developer mixture comprising finely-divided toner particles electrostatically clinging to the surface of carrier particles having an average particle size of between about 1 micron and about 1,000 microns, said carrier particles comprising a core surrounded with a thin outer coating comprising a substituted and/or unsubstituted poly(p-xylylene) polymer, said developer mixture being characterized as possessing triboelectric properties suitable for reversal development of positively charged electrostatic latent images.

2. An electrostatographic developer mixture according to claim 1 wherein said poly(p-xylylene) polymer is a homopolymer.

3. An electrostatographic developer mixture according to claim 1 wherein said poly(p-xylylene) polymer is a copolymer.

4. An electrostatographic developer mixture according to claim 1 wherein said thin outer coating is from between about 50 Angstroms and about 5 microns in thickness.

5. An electrostatographic developer mixture according to claim 1 wherein said core comprises a metal.

6. An electrostatographic developer mixture according to claim 5 wherein said metal comprises steel.

7. An electrostatographic developer mixture according to claim 1 wherein said poly(p-xylylene) contains repeating units of the structures

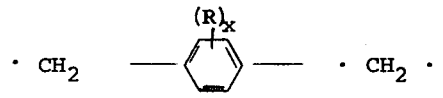

and

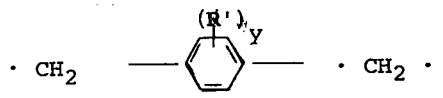

wherein R and R′ are nuclear substituents selected from the group consisting of alkyl, aryl, alkenyl, amino, cyano, carboxyl, alkoxy, hydroxy alkyl, carbaloxy, hydroxyl, nitro, and halogen groups which may be the same or different, and x and y are each integers from 1 to 4, inclusive.

8. An electrostatographic developer mixture according to claim 7 wherein *x* and *y* are the same and R and R′ are the same and said poly(p-xylylene) is a homopolymer having the structure:

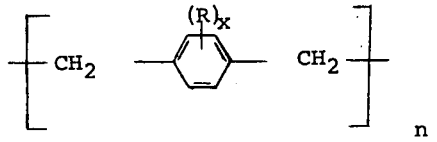

9. An electrostatographic developer mixture according to claim 7 wherein R and R′ and/or *x* and *y* are different and said poly(p-xylylene) is a copolymer having the general structure:

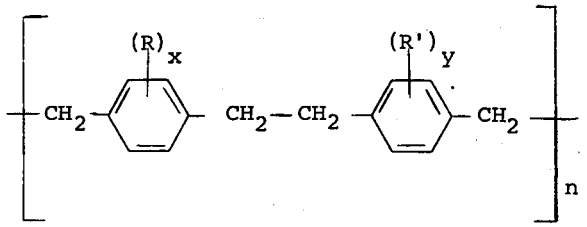

10. An electrostatographic developer mixture comprising finely-divided toner particles electrostatically clinging to the surface of carrier particles having an average particle size of between about 1 micron and about 1,000 microns, said carrier particles comprising a core having a first layer of a substituted silicon compound containing an ethylenically unsaturated group bonded to the silicon of the silicon compound by a carbon to silicon bond and at least one hydrolyzable group attached directly to the silicon of the silicon compound, and a second outer layer comprising a substituted and/or unsubstituted poly(p-xylylene) polymer, said developer mixture being characterized as possessing triboelectric properties suitable for reversal development of positively charged electrostatic latent images.

11. An electrostatographic developer mixture according to claim 10 wherein said silicon compound is gammamethacryloxy-propyltrimethoxy silane.

* * * * *